United States Patent [19]

Flood

[11] Patent Number: 4,884,307

[45] Date of Patent: Dec. 5, 1989

[54] POCKET TOOL

[76] Inventor: Ralph Flood, 3883 Sunbeam Dr., Los Angeles, Calif. 90065

[21] Appl. No.: 239,698

[22] Filed: Sep. 2, 1988

[51] Int. Cl.[4] ..... B25F 1/04

[52] U.S. Cl. ..... 7/156; 7/162; 7/163; 7/167; 30/162

[58] Field of Search ..... 7/152, 158, 163, 165, 7/167, 170, 148, 118, 119, 163, 164; 30/151, 152, 162, 143

[56] References Cited

U.S. PATENT DOCUMENTS

| | | | |
|---|---|---|---|
| 366,112 | 2/1886 | Holdsworth | 30/152 |
| 1,057,525 | 4/1913 | Bruecker | 7/158 |
| 1,275,364 | 8/1918 | Bassisty | 7/158 |
| 1,853,672 | 4/1932 | Dodson | 30/162 |
| 2,611,178 | 9/1952 | Whipple et al. | 7/167 |
| 3,461,469 | 8/1969 | Morrision | 7/165 |
| 4,669,140 | 6/1987 | Miceli | 7/158 |

FOREIGN PATENT DOCUMENTS

| | | | |
|---|---|---|---|
| 230000 | 7/1987 | European Pat. Off. | 30/162 |

*Primary Examiner*—Roscoe V. Parker

[57] ABSTRACT

A pocket tool having a retractable blade that can be slidably extended from a casing in either of two directions. End sections of the blade are specially configured to perform tool functions, such as sawing, cutting, filing, screw-driving, or bottle cap opening. A special latch structure is provided for firmly and rigidly retaining the blade in various positions of adjustment.

28 Claims, 2 Drawing Sheets

POCKET TOOL

BACKGROUND OF THE INVENTION

This invention relates to a pocket tool wherein a flat blade structure is slidably disposed in a hollow casing for movement between a storage position contained entirely within the casing and two different operating positions extended partly out of the casing. Devices incorporating my invention are somewhat similar to devices shown in U.S. Pat. No. 336,112 to Holdsworth or U.S. Pat. No. 1,853,672 to Dodson.

SUMMARY OF INVENTION

This invention contemplates a pocket tool that includes a hollow elliptical casing having internal straight side surfaces and two open ends; the casing defines a slideway for slidably supporting flat blade structure, whereby the blade structure can be manually moved in opposite directions from a central "storage" position entirely within the casing to two different operation positions extending from different ends of the casing.

The end sections of the blade structure are configured differently to perform different tool functions. For example, one end section of the blade structure may be configured to define a cutting knife, toothed saw, file, and phillips head screw driver. The other end section of the blade may be configured to define a flat blade screw driver and bottle cap opener.

By manually extending the blade structure in opposite directions from the hollow casing it is possible to effectively provide several different tools (depending on the direction of blade structure movement). hen the blade structure is in its "storage" position the hollow casing acts as a protective sheath to prevent sharp surfaces on the blade structure from cutting the person or the person's clothing. When the blade structure is in either of its operating positions the casing acts as a handle structure.

I provide a positive-acting latch means for releasably retaining the blade structure in each of its three adjusted positions (storage position and two operating positions). The latch means preferably includes a depressible latch button that must be manually depressed before the blade structure can be moved from its storage position to either operating position. The blade structure cannot accidently shift or move out of the casing so as to cut or injure the person or his clothing.

During use of the blade structure the latch means prevents the blade structure from accidently (or suddenly) being retracted into the casing so as to cause injury to the person. The blade structure is positively locked in its extended operating position, with the casing and blade structure being rigidly and firmly connected together. The person is thus assured that the particular function being performed (e.g. sawing, cutting, filing, etc.) will be accomplished without undesired collapse or movement of the blade structure. The latch means is positive-acting; it does not depend on friction or manual pressure to retain the blade structure in adjusted position.

One object of the invention is to provide a pocket tool having a retractable blade structure capable of performing a wide variety of different functions, e.g. cutting, sawing, filing, screw driver action, etc.

Another object of the invention is to provide a pocket tool having a retractable blade structure that can be used safely, without danger that the blade structure will suddenly and inadvertently shift or retract so as to cause injury to the person.

A still further object of the invention is to provide a pocket tool having a retractable blade structure, wherein the overall size of the tool is relatively small, such that the tool can be conveniently and comfortably retained in the person's pocket.

An additional object is to provide a pocket tool having a retractable blade structure, wherein the blade structure can be easily moved from one position of adjustment to another position of adjustment by essentially a one-handed operation.

A further object of the invention is to provide a pocket tool of the "retractable blade" type, wherein the tool is constructed of a comparatively small number of component parts, whereby the tool can be marketed at a relatively low selling price.

Another object is to provide a pocket tool case design that minimizes the possibility of the blade seizing in the case, due for example to presence of dirt or other foreign material lodging in the case.

A further object is to provide a blade-to-case locking mechanism that has only two components, whereby the mechanism is not apt to loosen or wear out.

THE DRAWINGS

DESCRIPTION OF A PREFERRED EMBODIMENT OF THE INVENTION

Figure 1:
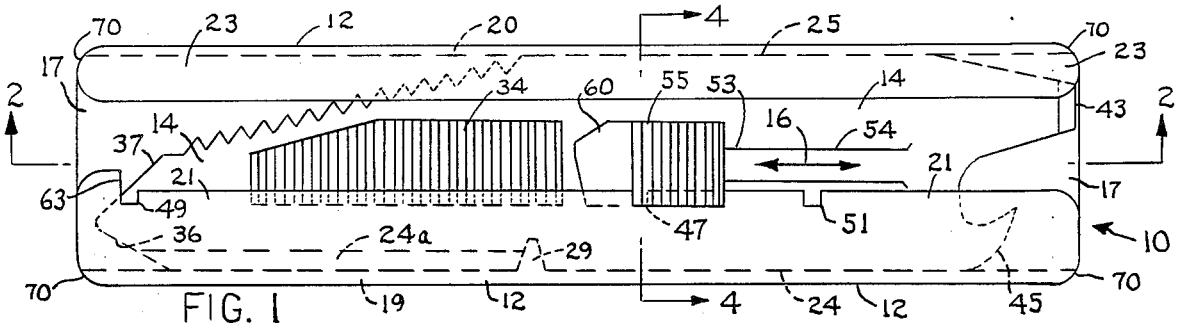
FIG. 1 is a side elevational view of a pocket tool constructed according to the teachings of my invention.

FIG. 1 shows a pocket tool 10 that comprises hollow elongated casing 12 and flat blade structure 14. The blade structure is slidably mounted within the casing for longitudinal adjustment, as indicated by arrow 16 in FIG. 1.

Figure 7:
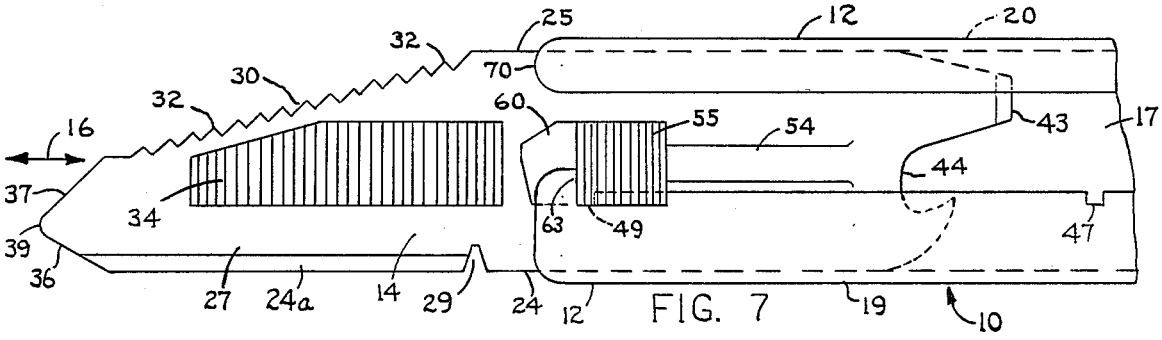
FIG. 7 is a fragmentary elevational view in the same direction as FIG. 1, but with the blade structure in a different position of adjustment.
Figure 8:
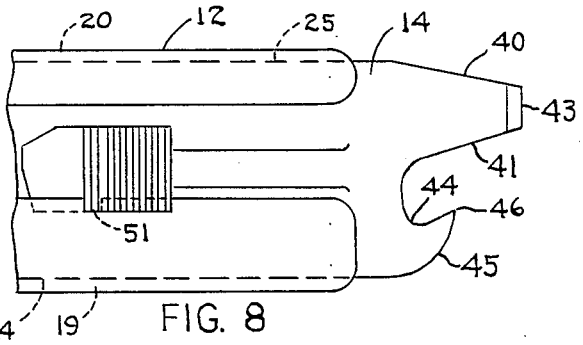
FIG. 8 is a view in the same direction as FIGS. 1 and 7, but particularly illustrating a different section of the blade structure.

Blade structure 14 is slidably adjustable from a "storage" position entirely within casing 12 (FIG. 1) to two different "operating" positions (FIGS. 7 and 8). FIG. 7 illustrates the blade structure adjusted to the left, such that its left end section extends out of casing 12. FIG. 8 fragmentarily shows the blade structure adjusted to the right, such that its right end section extends our of casing 12. In the adjusted position of FIG. 7 the blade structure can be used to perform the functions of sawing, cutting, filing, and phillips screw driving. In the adjusted position of FIG. 8, blade structure 14 can be used as a straight-bladed screw driver or as a bottle cap opener.

Figure 5:
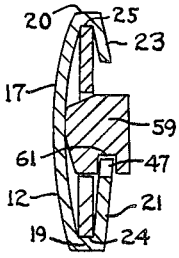
FIG. 5 is a sectional view taken in the same direction as FIG. 4, but with a component part of the assembly in a different position of adjustment.
Figure 4:
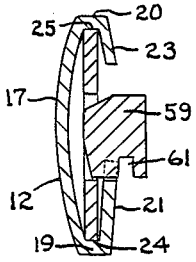
FIG. 4 is a sectional view taken on line 4—4 in FIG. 1.
Figure 6:
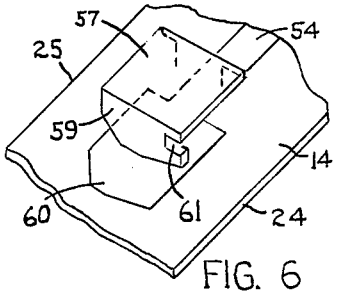
FIG. 6 is a perspective view of a latch mechanism used in the FIG. 1 assembly.

Casing 12 is a straight-sided hollow structure having a C-shaped cross-section, as seen in FIGS. 4 and 5. The casing comprises a bowed (elliptical) rear wall 17, two narrow edge walls 19 and 20 extending from wall 17, and two inturned flanges 21 and 23 extending inwardly from walls 19 and 20. Flanges 21 and 23 are spaced and configured to slide over tabs on pop cans for can-opening purposes.

Blade structure 14 is slidably arranged within the C-shaped casing so that longitudinal side edges 24 and 25 of the blade structure are in slidable contact with the inner surfaces of casing walls 19 and 20. Walls 19 and 20 are only slightly wider than the thickness of blade structure 14, to minimize side play of the blade structure in the casing.

Rear wall 12 and the two casing flanges 21 and 23 are obtusely angled, i.e. slightly divergent, so as to be substantially out-of-contact with face areas of blade structure 14. Casing edge walls 19 and 20 cooperate with the associated walls 17, 21 and 23 to form a V-shaped slideways for blade structure 14. The blade structure is in slidable contact primarily with edge walls 19 and 20, with only minimal contact between the blade structure and walls 17, 21, and 23. The aim is to provide a minimum friction slideway for the blade structure so that the blade structure can be manually moved back and forth in the arrow 16 direction with minimal manual effort. The blade structure has a preferred wall thickness of about 0.040 inches.

The extreme left end section of blade structure 14 comprises a longitudinal edge 24*a* that is sharpened to form a cutting knife, designated generally by numeral 27. A notch 29 is formed in the blade structure to prevent the blade material from cracking where the blade edge changes its contour, i.e. at the end of the sharpened edge.

The extreme left end section of the blade structure also includes a saw toothed edge 30 that extends at an acute angle to the principal longitudinal dimension of the blade structure, as represented by directional arrow 16. The saw teeth 32 on blade edge 30 may have a tooth depth of about 0.030 inch, and a width of about twenty teeth per inch. By accurately angling the toothed edge 30 it is possible to slightly increase the number of saw teeth for a given length blade structure (compared to a blade structure having teeth on its longitudinal edge). Preferably there are at least ten teeth on the saw edge 30. The drawing shows fourteen teeth.

During the sawing operation the person uses casing 12 as a handle structure to move blade structure 14 back and forth across the work surface; saw movement is generally parallel to toothed surface 30. The acute angulation of toothed surface 30 is helpful during the sawing operation in that the saw penetrates some distance into the work before the adjacent end of the casing 12 becomes a potential obstruction to saw movement. A relatively long saw stroke motion can be used, at least during the early stages of the sawing operation.

Face area 34 on the blade structure has a number of closely-spaced transverse grooves therein that serve to define a file surface. The grooves are generally V-shaped to form raised sharpened cutting edges on the face area of the blade structure. With a blade structure length of about three inches the filing surface would have a length of about one inch and a width of about one half inch. The filing grooves can be formed on either face of blade structure 14 (or on both faces).

The drawings show the file surface to be formed by transverse grooves cut into the blade face. Other methods may be used to form a file surface. For example, the file surface may be formed by sand blasting the surface, or by selective etching, or by adding material to the blade surface.

Blade structure 14 includes two convergent tip surfaces 36 and 37 that merge into a blunt rounded nose 39. Surfaces 36 and 37 converge at an included angle of about seventy five degrees. Rounded noes 39 has a preferred radius of curvature of about 0.040 inch. The blade thickness is about 0.040 inch.

The blade tip dimensions are selected so that the tip of the blade structure can be inserted into the drive slots in phillips head screws. The blade structure is thus adapted for use as a screw driver for phillips head screws.

By way of summarization, when blade structure 14 is extended leftwardly from casing 12, to the position shown in FIG. 7, the tool can be used either as a cutting knife, or as a saw, or as a file, or as a phillips head screw driver. Casing 12 acts as a handle structure for the tool.

Blade structure 14 can also be slidably extended from the right end of casing 12, to the position shown in FIG. 8. The right end section of the blade structure includes two straight convergent edges 40 and 41, and an interconnecting flat nose edge surface 43. The edge surfaces cooperatively define a spade-like structure that can function as a flat blade screw driver.

The right end section of blade structure 14 further includes a concave curved edge surface 44 that extends from edge surface 43 in curl-like fashion for an accurate distance of about two hundred fifty degrees (slightly less than three quarters of a complete circle). A convex curved edge surface 45 extends from longitudinal edge 24 into convergence with concave surface 44 to form a sharpened tip 46. The dimensions and curvatures are selected, such that the defined structure can be used as a bottle cap opener.

A positive-acting latch means is provided for releasably retaining blade structure 14 in each of its three adjusted positions (FIGS. 1, 7 or 8). The latch means comprises three longitudinally spaced slots 47, 49 and 51 formed in the free edge of casing flange 21; each slot acts as a positive detent or keeper for the latch means. The latch means further includes an arm structure 53 formed integrally with blade structure 14.

Figure 2:
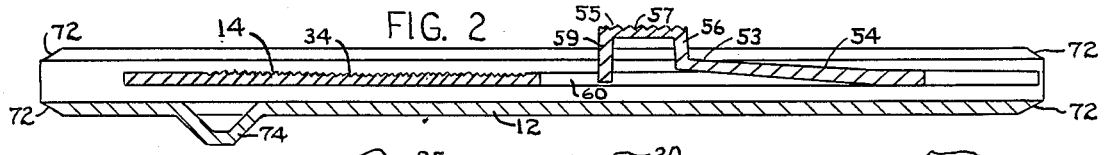
FIG. 2 is a sectional view taken on line 2—2 in FIG. 1.
Figure 3:
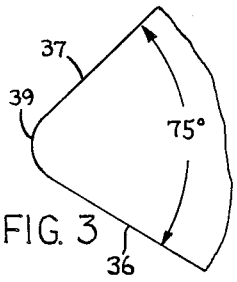
FIG. 3 is an enlarged view of a structural detail used in the FIG. 1 construction.

Arm structure 53 comprises an essentially flat spring arm 54 that extends from blade structure 14 in cantilever fashion at a slight angle of about five degrees (FIG. 2). A protuberance 55 is formed at the free end of spring arm 54. As seen in FIG. 2, protuberance 55 has a channel cross-section, that includes an upstanding wall 56, web wall 57, and terminal end wall 59. End wall 59 extends generally normal to the plane of blade structure 14, as seen in FIG. 2; a slot 61 is formed in a side edge of wall 59.

Wall 57 is designed to be engaged by a person's thumb, whereby protuberance 55 can be depressed against the biasing force of spring arm 54. FIGS. 2 and 4 show the position of protuberance 55 in an unstressed condition wherein spring arm 54 holds the protuberance away from casing rear wall 17. FIG. 5 shows the protuberance in its depressed condition (with thumb pressure applied to wall 57).

The exposed (upper) face of web wall 57 may have transverse grooves therein, similar to the "file" grooves in area 34 of the blade structure. The grooves in wall 57 can serve a "filing" function. Additionally the grooves serve to roughen the wall 57 surface, thereby minimizing the possibility that the person's thumb might slip off the wall 57 surface while protuberance 55 is being depressed.

Figure 9:
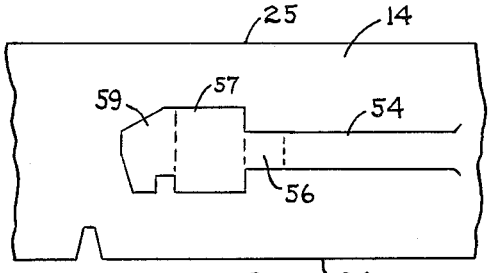
FIG. 9 is a fragmentary side elevational view of a blade structure blank, showing how the structure is slit to form a latch mechanism.

Spring arm 54 and protuberance 55 are preferably formed out of the blade structure 14 material by slitting the blade structure and reforming the material encompassed by the slits; a progressive die mechanism may be used to slit and reform the material. FIG. 9 shows the general nature of the slit blank (prior to bending the spring arm and forming the channel cross-sectioned protuberance 55). The bend lines in the material are shown as dashed lines in FIG. 9. FIG. 2 shows the final cross-sectional shape of the latch arm structure. The slitting and forming operations cause an irregularly shaped hole to be formed in blade structure 14 numeral 60 references the hole.

Blade structure 14 is installed (inserted) into casing 12 by sliding it through the right end of the casing (from right to left in FIG. 1). During the installation process thumb pressure is applied to web wall 57, such that slot 61 in wall 59 registers with the free edge of casing flange 21. As blade structure 14 is moved in a right-to-left direction slot 61 rides along the edge of casing flange 21; FIG. 5 illustrates the slot-flange relationship.

When (or before) blade structure 14 reaches the FIG. 1 position (sometimes termed the "storage" position) manual pressure on web wall 57 is removed, whereupon spring arm 54 biases protuberance 55 away from casing rear wall 17 to the position shown in FIG. 4. Latch wall 59 moves into slot 47 in casing flange 21 to retain the blade structure in its FIG. 1 position As long as protuberance 55 is biased away from casing wall 17 (by spring arm 54) blade structure 14 will be locked in place in casing 12; latch wall 59 will be retained in slot 47 to prevent the blade structure from moving to the left or to the right.

Blade structure 14 can be moved to the FIG. 7 position by applying thumb pressure on wall 57 and exerting a right-to-left push force on protuberance 55. As soon as wall 59 is located to the left of slot 47 the thumb pressure can be removed; slot 61 will automatically ride on the free edge of casing flange 21 until wall 59 registers with slot 49. When wall 59 is in registry with slot 49, spring arm 54 will automatically bias protuberance 55 away from casing rear wall 17, thereby causing wall 59 to lock into slot 49.

The interlocking relationship between wall 59 and slot 49 provides a firm rigid connection between the blade structure and casing 12. The tool can be used for cutting, sawing, driving screws, etc., with assurance that the blade will not slip or otherwise shift into or out of the handle (casing) structure.

Blade structure 14 can be moved from the FIG. 1 storage position to the FIG. 8 operating position by applying thumb pressure on wall 57 and moving the protuberance in a left-to-right direction. The adjusting operating is similar to that described above in connection with movement to the FIG. 7 position.

Blade structure 14 can be completely removed from casing 12, e.g. to sharpen the blade cutting edge or to replace the blade. However, for safety reasons I prefer that the blade not be withdrawn through the left end of casing 12, since the person would then be tempted to grasp the sharp cutting edge surfaces **24*a* and 32, with resulting hand injury. To prevent removal of the blade through the left end of the casing I have designed casing flange 21 with a projecting shoulder 63 at the extreme left end of casing 12. With the blade structure in the FIG. 7 position it is impossible to move it further to the left because shoulder 63 is in the direct path of wall 59**.

The right end section of casing flange 21 is unobstructed. Accordingly, blade structure 14 can be removed from casing 12 by sliding it through the right end of the casing. The various edge surfaces 40, 41 and 45 are not sharpened surfaces; therefore the right end section of the blade structure can be safely grasped during the blade removal operation.

The illustrated tool is intended to be carried in a person's pocket. To prevent injury to the person or damage to the person's clothing the edge surfaces and external corner surfaces of casing 12 are preferably rounded or chamfered, as at 70 and 71. An attachment loop 74 (FIG. 2) may be lanced out of casing wall 17 to facilitate attachment of the tool to the person's key chain, not shown. The tool has a relatively small overall size e.g. three inches long and about two-thirds inches wide) so that it can fit in a person's pocket.

If desired "inch" or "millimeter" markings can be applied to the casing to enable use of the casing as a small ruler. Other modifications and additional features may be utilized while still practicing the invention.

Figure 10:
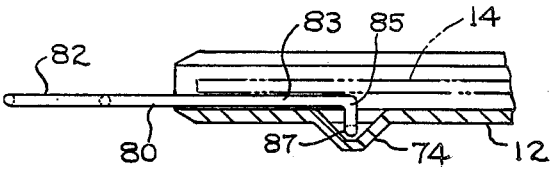
FIG. 10 is a fragmentary sectional view through the FIG. 1 tool, showing a key ring attachment mechanism.

FIG. 10 illustrates a wire connection element 80 attachable to casing 12 for connecting the casing to a person's key ring. Wire element 80 comprises a circular loop portion 82, a straight shank section 83, and a hook-shaped end section 85.

With blade structure 14 removed from casing 12 the hook-shaped end section section 85 of wire element 80 can be extended into the depression formed by the lanced-out section 74 of the casing wall. The extreme tip end 87 of wire element 80 extends into the plane of the case in FIG. 10. Tip end 87 can thus extend along the outer face of the casing to prevent element 80 from being dislodged from casing 12, especially after blade structure 14 has been reinserted into casing 12. FIG. 10 shows the blade structure in phantom. When the blade structure is disposed within the casing it overlies wire element 80 to keep the element in position for attaching the tool to a person's key ring.

Figure 12:
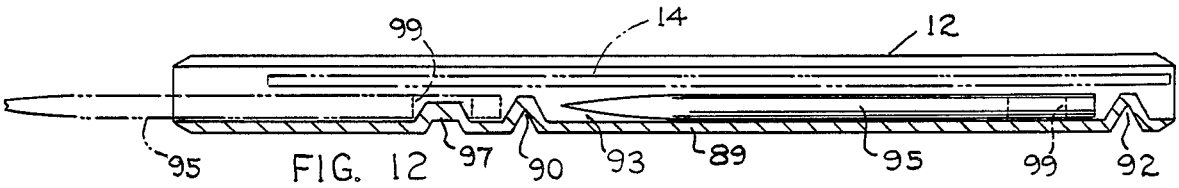
FIG. 12 is a longitudinal sectional view of the FIG. 11 embodiment.
Figure 11:
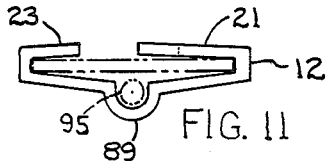
FIG. 11 is an end view of another embodiment of the invention.

FIGS. 11 and 12 show another form that the invention can take. The blade structure is the same as the blade structure shown in FIGS. 1 through 9; the casing structure differs slightly. As shown in FIG. 11, the casing rear wall has a longitudinal semi-circular bulge 89 extending therealong. A channel is thus formed within the casing alongside the space occupied by blade structure 14; FIGS. 11 and 12 show the blade structure in phantom.

At points 90 and 92 wall 89 is deformed inwardly toward the space occupied by blade structure 14; a longitudinal pocket 93 is thereby formed within the casing for storage of an awl (large needle) 95. The awl is inserted into pocket 93 after first removing blade structure 14. When the blade structure is reinserted into casing 12 the awl is trapped (retained) in pocket 93.

Wall 89 is also deformed at 97 to form a short post. With blade structure 14 removed from casing 12, awl 95 can be extended into the left end of the casing and manipulated so that the eye 99 of the awl (needle) is positioned on post 97. The needle can be locked onto the post by reinserting blade structure 14 into casing 12 to the pOsition shown in FIG. 12 (phantom lines).

The clearances ar such that blade structure 14 firmly holds awl 95 in an extended position for use as a piercing device in leather, rubber, wood, etc.; casing 12 functions as a handle when needle element 95 is in its extended position (phantom lines in FIG. 12).

Figure 13:
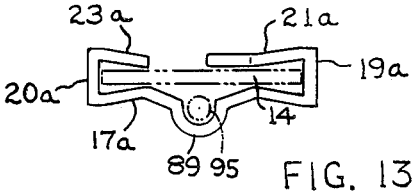
FIG. 13 is an end view of a further embodiment of the invention.

FIG. 13 illustrates a variant in the casing design. In this case the casing rear wall 17*a* and casing flanges 21*a* and 23*a* include convergent sections that form guide surfaces for blade structure 14. The guide surfaces in this case are spaced inwardly from the casing edge walls 19*a* and 20*a*. Blade structure 14 has essentially line contact with the casing guide surfaces, such that the blade structure can be readily moved between its adjusted positions (after depression of the associated latch means).

A primary feature of the invention is the latch means comprised of casing slots 47, 49 and 51, and the associated latch arm structure 53. The latch means is a positive-acting mechanism that does not depend on friction or manual pressure to maintain blade structure 14 in any of its three adjusted positions.

The drawings show blade structure selectively extendable through both ends of the associated casing. The latch mechanism of my invention could also be applied to a arrangement wherein the blade structure was extendable through only one end of the associated casing.

I claim:

1. A pocket tool comprising an elongated hollow casing defining an internal slideway; a flat blade structure slidably positioned in said slideway for two way movement between a first storage position entirely within the casing, a second operating position wherein one of its end sections projects out of the casing; said one end section being configured to define a toothed saw, a cutting knife, a file, and a screw driver; and a third operating position wherein its other end section projects out of the casing; said other end section of the blade structure comprises a tip area that includes two straight convergent edges and an interconnecting flat nose which cooperatively define a flat blade screw driver; said other end section of the blade structure further comprising a first concave curved end edge extending from one of the aforementioned convergent edges for approximately two hundred fifty degrees, and a second convex curved edge extending from a longitudinal edge of the blade structure into convergence with the tip end of the concave end edge, said curved edges being contoured to cooperatively form a bottle cap opener; and a positive-acting latch means for releasably retaining the blade structure in each of its three adjusted positions; said latch means comprising three longitudinally spaced detents on the hollow casing, and a manually-depressible latch mechanism carried on the blade structure for selective interlocking engagement with said detents; said depressible mechanism comprising an elongated cantilever arm having a flexible hinge connection to the blade structure, and a thumb-operated protuberance carried on the free end of said arm for movement into end out of interlocking engagement with any one of said detents in response to thumb pressure activation forces.

2. The pocket tool of claim 1 wherein said one end section of the blade structure comprises a first longitudinal edge, sharpened to form a cutting knife, a second edge acutely angled to the slide axis, at least ten saw teeth formed along said second edge, a convergent tip area connecting said first and second edges, substantially flat nose on the tip area shaped to act as a phillips head screw driver, and a large number of closely-spaced transverse abrasive grooved texture in the flat surface of the blade structure defining a file.

3. The pocket tool of claim 1 wherein said elongated arm and associated protuberance are formed by punching out an intermediate section of the blade structure.

4. The pocket tool of claim 3 wherein said elongated arm has an unstressed position acutely angled to the plane of the blade structure.

5. The pocket tool of claim 4 wherein said protuberance has a channel cross-section viewed in a transverse direction parallel to the plane of the blade structure.

6. The pocket tool of claim 4 wherein the channel cross-sectioned protuberance includes a terminal wall that can be moved into and out of locking engagement with any one of the dents.

7. The pocket tool of claim 6 wherein said hollow casing has a cross-section that includes a longitudinal flange extending essentially parallel to one face of the blade structure; said longitudinally-spaced detents comprising three longitudinally-spaced slots formed in a free edge of said longitudinal flange; the aforementioned terminal wall having a slot therein rideable along the free edge of the casing flange during movement of the blade structure between its three adjusted positions.

8. The pocket tool of claim 7 wherein said terminal wall extends generally normal to the general plane of the blade structure; the slot in the terminal wall being moveable through any one of the slots in the casing flange when the terminal wall registers with any casing flange slot.

9. The pocket tool of claim 8 wherein said terminal wall has a thickness that is slightly less than the width of each slot in the casing flange, whereby said terminal wall prevents the blade structure from slidable movement when it is located in any one of the slots in the casing flange.

10. A pocket tool comprising an elongated hollow casing having a C cross-section that includes a longitudinal web wall and the two longitudinal flanges; at least one of the ends of said casing being open, whereby the casing defines a slideway; a slot blade structure slideably positioned in said slideway for movement between a first storage position entirely within the casing, and a second operating position wherein one of its end sections projects out of the casing; at least three longitudinally-spaced slots formed in a free edge of one of the casing flanges; a positive-acting latch mechanism carried by the blade structure for locking said blade structure in either the storage position or the operating position; said latch mechanism comprising a flange-engaged wall extending normal to the blade structure plane and transverse to the direction of blade structure movement; said flange-engaged wall having a slot therein rideable along the free edge of said one casing flange during slidable movement of the blade structure.

11. The pocket tool of claim 10 and further comprising a spring means for moving the flange-engaging wall into a locking position in either one of the slots in the said one casing flange.

12. The pocket tool of claim 10 therein said latch mechanism comprises an elongated spring arm having a flexible hinge connection with the blade structure, a channel cross-sectional protuberance on the free end of said spring arm; said protuberance including a web wall extending generally parallel to the blade structure plane for receiving a thumb pressure thereon, to thereby move the flange-engaging wall to a position wherein its slot registers with the free edge of said one casing flange.

13. The pocket tool of claim 12 wherein said spring arm and channel cross-sectional protuberance are integrally added to the blade structure.

14. The pocket tool of claim 12 wherein said spring arm and channel cross-sectional protuberance are formed by punching out an intermediate section of the blade structure.

15. The pocket tool of claim 14 wherein said spring arm has an unstressed position acutely angled to the plane of the blade structure at an angle of about five degrees.

16. The pocket tool comprising an elongated hollow casing that includes a rear wall, two narrow edge walls extending from said rear wall, and two inturned flanges extending inwardly from said narrow edge walls; a flat blade structure slidably positioned in said hollow casing for slidable movement between a storage positions entirely within the casing and at least two operating position partially extended out of the casing' said flat blade structure having longitudinal side edges contacting the casing edge walls to provide guidance in the blade structure plane; said casing rear wall and inturned flanges having only limited contact with face areas of the blade structure to provide minimal resistance to blade structure movement.

17. The pocket tool of claim 16 wherein the casing rear wall and inturned flanges are obtusely angled to the casing edge walls to define V-shaped slideways for the side edges of the blade structure.

18. The pocket tool of claim 16 wherein the casing rear wall and inturned flanges converge toward one another as they angle inwardly from the casing edge walls, such that the casing has essentially line contact with the blade structure faces at points inward the casing edge walls.

19. A pocket tool comprising an elongated hollow casing having a C cross-section, said casing including a bowed rear wall, two narrow edge walls extending from said rear wall, and two inturned flanges extending inwardly from said narrow edge walls; a flat blade structure slidably positioned in said hollow casing for slidable movement between a storage position entirely within the casing and at least two operating positions partially extended out of the casing; said flat blade structure having longitudinal side edges slidably contacting the narrow edge wall of the casing; said bowed rear wall and said inturned flanges being obtusely angled to the casing edge walls to define V-shaped slideways for the side edges of the blade structure.

20. The pocket tool of claim 19 and further comprising three longitudinally-spaced slots in an edge area of one of the casing flanges; and a manually-depressible latch mechanism carried on the blade structure for interlocking engagement with said slots, to thereby releasably retain the blade structure in either adjusted position.

21. The pocket tool of claim 20 and further comprising shoulder means on an end section of said one casing flange, said shoulder means being in the path of the latch mechanism to thereby prevent removal of the blade structure from the hollow casing.

22. The pocket tool of claim 21 wherein the other end section of said one casing flange in unobstructed, whereby the blade structure can be removed from the casing.

23. The pocket tool of claim 22 wherein the latch mechanism comprises a transverse wall extending normal to the blade structure plane, said transverse wall having a slot in one of its side edges that rides along the edge area of said one casing flange during slideable movement of the blade structure.

24. A pocket tool comprising an elongated hollow casing defining a slideway, a flat blade structure slidably positioned in said hollow casing for a slidable movement between a storage positions entirely within the casing and at least two operating position partially extended out of the casing; and means for attaching the casing to a person's key ring, said attaching means comprising a section (74) of the casing wall lanced outwardly to form a depression in the casing wall, and a wire connector element (80) having a shank section extendable within the casing along an interior face of the casing wall; a free end of the wire element shank section being extendable into the depression, said blade structure being slidably positioned to prevent removal of the connector element from the casing when the free end of the wire element is seated in the depression.

25. A pocket tool, according to claim 24, wherein the rear wall of the casing has a longitudinal channel forming bulge extending therealong, said wall being deformed at two points (90, 92) inwardly to form a storage space for an awl, into which the awl can be inserted when removing the blade structure (14).

26. A pocket tool, according to claim 25, wherein said wall is further deformed to form a post (97) so that the eye of the awl can be extended to the end of the casing for position at post (97), thereby locking the awl onto said post, on reinserting blade structure (14) on casing (12).

27. A pocket tool, according to claim 26, wherein the rear wall of the casing **(17*a*) and casing flanges (21*a* and 23*a*) include convergent sections to form guide surfaces for blade structure (14)**.

28. A pocket tool, according to claim 27, wherein "inch" or "millimeter" markings is applied to the casing flanges of the tool.

* * * * *